US010912976B2

(12) United States Patent
Zimmerman

(10) Patent No.: US 10,912,976 B2
(45) Date of Patent: Feb. 9, 2021

(54) SYSTEMS, MEDIA, AND METHODS FOR AN INTERACTIVE SPEED LADDER

(71) Applicant: Adam Zimmerman, St. Albans, WV (US)

(72) Inventor: Adam Zimmerman, St. Albans, WV (US)

( * ) Notice: Subject to any disclaimer, the term of this patent is extended or adjusted under 35 U.S.C. 154(b) by 46 days.

(21) Appl. No.: 16/249,674

(22) Filed: Jan. 16, 2019

(65) Prior Publication Data

US 2020/0222777 A1 Jul. 16, 2020

(51) Int. Cl.

| | |
|---|---|
| ***A63B 23/04*** | (2006.01) |
| ***A63B 24/00*** | (2006.01) |
| ***A63B 69/00*** | (2006.01) |
| ***E06C 1/56*** | (2006.01) |
| ***E06C 1/52*** | (2006.01) |

(52) U.S. Cl.

CPC ..... *A63B 69/0028* (2013.01); *A63B 23/04* (2013.01); *A63B 24/0062* (2013.01); *E06C 1/525* (2013.01); *E06C 1/56* (2013.01)

(58) Field of Classification Search

CPC ..... A63B 2022/0092; A63B 2071/065; A63B 2207/02; A63B 2220/56; A63B 2225/20; A63B 2225/50; A63B 23/0464; A63B 24/0087; A63B 26/003; A63B 69/0053; A63B 71/0622; A63B 71/0619; A63B 69/0028; A63B 24/0062; A63B 23/04; A63B 2220/833; A63B 2225/74; A63B 2220/836; G09B 19/0038; E06C 1/56; E06C 1/525

See application file for complete search history.

(56) References Cited

U.S. PATENT DOCUMENTS

| | | | | |
|---|---|---|---|---|
| 5,839,976 | A * | 11/1998 | Darr | A63B 5/22 473/414 |
| 7,625,319 | B2 * | 12/2009 | Kang | A63B 69/20 482/83 |
| 7,645,211 | B1 * | 1/2010 | Thomeczek | A63B 69/0053 482/1 |
| 9,993,715 | B2 * | 6/2018 | Merkel | A61B 5/6892 |
| 2016/0296801 | A1 | 10/2016 | De La Garza et al. | |
| 2018/0133551 | A1 * | 5/2018 | Chang | A63B 24/0075 |

FOREIGN PATENT DOCUMENTS

| | | | | |
|---|---|---|---|---|
| GB | 2571123 | * | 8/2019 | A63B 1/00 |

* cited by examiner

*Primary Examiner* — Jennifer Robertson
*Assistant Examiner* — Catrina A Letterman
(74) *Attorney, Agent, or Firm* — Dinsmore & Shohl LLP; Monika L'Orsa Jaensson, Esq.

(57) ABSTRACT

Systems, media and methods for an interactive speed ladder are provided. A system includes a speed ladder that has parallel side members and parallel cross members each connecting each of the side members. The system may further include a receiving module configured to receive light path sequence data and foot movement data of a user relative to the speed ladder, wherein the light path sequence data and the foot movement data are received from different sources. The system may also further include lights, located within the cross members, configured to display a light path sequence based upon sequence data received prior to a start of the sequence and an output module configured to output user foot movement data.

15 Claims, 10 Drawing Sheets

SYSTEMS, MEDIA, AND METHODS FOR AN INTERACTIVE SPEED LADDER

TECHNICAL FIELD

The present application generally relates to activity tracking, such as the tracking and analysis of the movements of speed ladder users.

BACKGROUND

Speed ladders are used for drills to enhance a participant's speed and agility. A participant is often observed by others and may have their time recorded. While such observations and times can provide some useful information, participants do not self-record and receive detailed electronic data as to their speed ladder usage.

Accordingly, a need exists for systems that provide analysis and feedback to speed ladder users, along with media and methods of use of such systems.

SUMMARY

In one embodiment, a system may include a speed ladder that comprises a plurality of parallel side members and a plurality of parallel cross members each connecting each of the side members. The speed ladder may also comprise a receiving module configured to receive light path sequence data and foot movement data of a user relative to the speed ladder, wherein the light path sequence data and the foot movement data are received from different sources. The speed ladder may further comprise a plurality of lights, located within the cross members, configured to display a light path sequence based upon sequence data received prior to a start of the sequence and an output module configured to output user foot movement data.

In another embodiment, a non-transitory computer readable medium embodies computer-executable instructions, that when executed by a processor, cause the processor to receive, from multiple user sensors attached to a user, user foot movement data relative to a speed ladder. The processor may also create and display a record associated with the user based upon the foot movement data. The processor may further output, to multiple lights within the speed ladder, light path sequence data configured to activate a light path sequence in the multiple lights.

In yet another embodiment, a method may comprise receiving, from a plurality of user sensors attached to a user, foot movement data of the user relative to a speed ladder. The method may further comprise creating and displaying a record associated with the user based upon the foot movement data. The method may also include outputting, to a plurality of lights within the speed ladder, light path sequence data configured to activate a light path sequence in the plurality of lights.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments of the present disclosure are directed to methods, systems, and media for an interactive speed ladder that utilizes sensor data and interacts with a graphical user interface. For a given foot placement sequence (or multiple foot placement sequences), various sensors may be available to capture different types of foot movement from the sequence. For example, a sensor may capture an angle, path, height, and/or speed for each foot placement in a foot placement sequence. Additionally, a graphical user interface may be utilized to design, modify, and/or review a foot placement sequence, i.e., data which a user does not obtain on their own while using the speed ladder. Another approach, having another person manually observe/analyze a user's foot placement sequence, is not always an option, and is time-consuming and not completely accurate due to a variety of reasons, including human subjectivity and imprecision. Another approach, filming a user's step sequence, is time and resource intensive without producing data readily available for analysis. Utilizing sensors and a graphical user interface with a speed ladder can provide a more accurate, reliable, quickly-available, and readily-accessible analysis of one or more foot movement sequences.

Figure 1A:
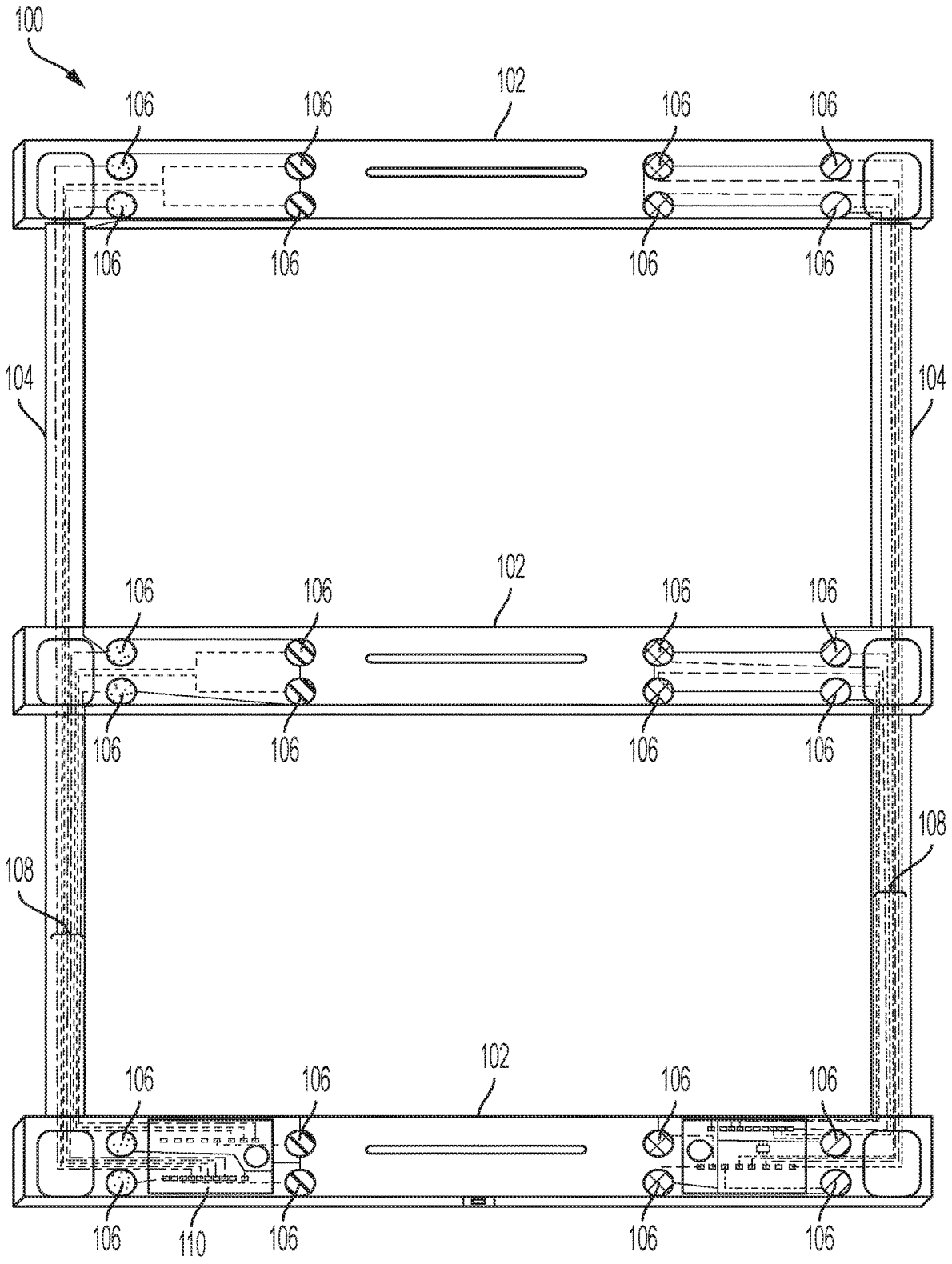
FIG. 1A schematically illustrates an exemplary operating environment featuring a speed ladder with LEDs, according to one or more embodiments shown and described herein.

Referring now to FIG. 1A, an exemplary operating environment featuring a speed ladder with LEDs is shown according to various embodiments. A speed ladder 100 may comprise any suitable number of cross members 102 and side members 104, which in this embodiment are orthogonal to each other. In other embodiments, the orientation of a cross member 102 and a side member 104 may be slanted, crooked, etc. In some embodiments, the orientation of a cross member 102 to a side member 104 may be different than another cross member 102 to a side member 104. In this embodiment, the cross members 102 have uniform dimensions (length, width, height), as do side members 104. In other embodiments, not all cross members 102 may have uniform dimensions and/or not all side members 104 may have uniform dimensions. Cross members 102 may be made of any suitable material(s). In this embodiment, a hard plastic is utilized, although any suitable material may be utilized that provides a translucent surface. In this embodiment a side member 104 may be made of a fabric material to provide for foldability and portability, although any suitable material may be utilized. In other embodiments, a harder material for side members 104 may be utilized. Side members 104 may be made of any suitable material(s). In some embodiments, not all cross members 102 need be made of the same material(s). In some embodiments, not all side members 104 need be made of the same material(s).

The speed ladder 100 may feature light emitting diodes (LEDs) 106 in the cross members 102. Any suitable lighting indicator may be utilized, such as incandescent, halogen, compact-fluorescent, fluorescent, solar, laser, flame, and the like. While each cross member 102 in this embodiment has eight LEDs, in other embodiments a cross member 102 may have any suitable number of LEDs 106. In some embodiments, one or more side members 104 may have LEDs 106 or other lighting indicators. In this embodiment, the cross members 102 are translucent to allow some of the light of the LED 106 to be visible to a user of the speed ladder 100. In other embodiments, only the portion of a cross member 102 above an LED 106 is translucent (i.e., the portion below an LED 106 may be opaque). In some embodiments, a transparent material such as clear plastic or hardened glass may be utilized. In this embodiment, wiring 108 is provided within the side members 104 and cross members 102 to provide power and communication to the LEDs 106 from the communications module 110. In other embodiments, wireless power and/or communication mechanisms may be utilized, such as wireless communications (RFID, NFC, etc.) and battery-operated LEDs. The communications module 110 may be any suitable type of electronics to facilitate communications and/or power to and/or from the speed ladder 100. For example, the communications module 110 may utilize any suitable wireless and/or wired technology to receive light path sequence data (discuss below in more detail). The communications module 110 may also be utilized to receive power from external sources (electric outlet, battery, solar cell/panel, wireless power transmittal, etc.). The communications module 110 may transmit, via the wiring 108, the light path sequence data (in the form of individualized lighting and timing instructions which may be analog or digital) to each LED 106. An LED may be connected to the communications module 110 with positive and negative wires, along with a separate ground. An LED 106 may also provide, via the wiring, confirmation feedback and/or error feedback to the communication module 110, which may be utilized to provide a visual representation of the speed ladder 100 in the app discussed in more detail below. The communications module 110 may further have a receiving module to receive light path sequence data and foot movement data of a user relative to the speed ladder and/or an output module configured to output user foot movement data. In some embodiments, the sensor data may be provided first to the speed ladder 100 via the receiving module, which may then be passed on (with or without foot movement sequence data and/or light path sequence data) via the output module of communications module 110 to the interface.

In this embodiment, each cross member 102 has 8 LEDs, where four LEDs are up front and four are in back, such that a placement spot for foot placement would be indicated by a front LED 106 on the rear cross member 102 and a rear LED 106 on the front cross member 102. Additionally, as some foot movement sequences may utilize stepping outside of the speed ladder 100 (such as to the side of an outer side member 104), the outer LEDs on a cross member 102 could be utilized to indicate stepping to the outside of a portion near the lit up LED(s) 106. Similarly, the inner LEDs 106 may be utilized to indicate to the user that the placement spot to place their foot is inside the speed ladder 100 between the lit up cross members 102. In another embodiment, the ladder 100 need not have any LEDs, such that location data from a sensor 112 may be provided to communications module 110 and/or an interface 208 (discussed in more detail below). In this embodiment, the user may create/utilize their own custom foot movement sequence, rather than relying upon a light path sequence.

Figure 1B:
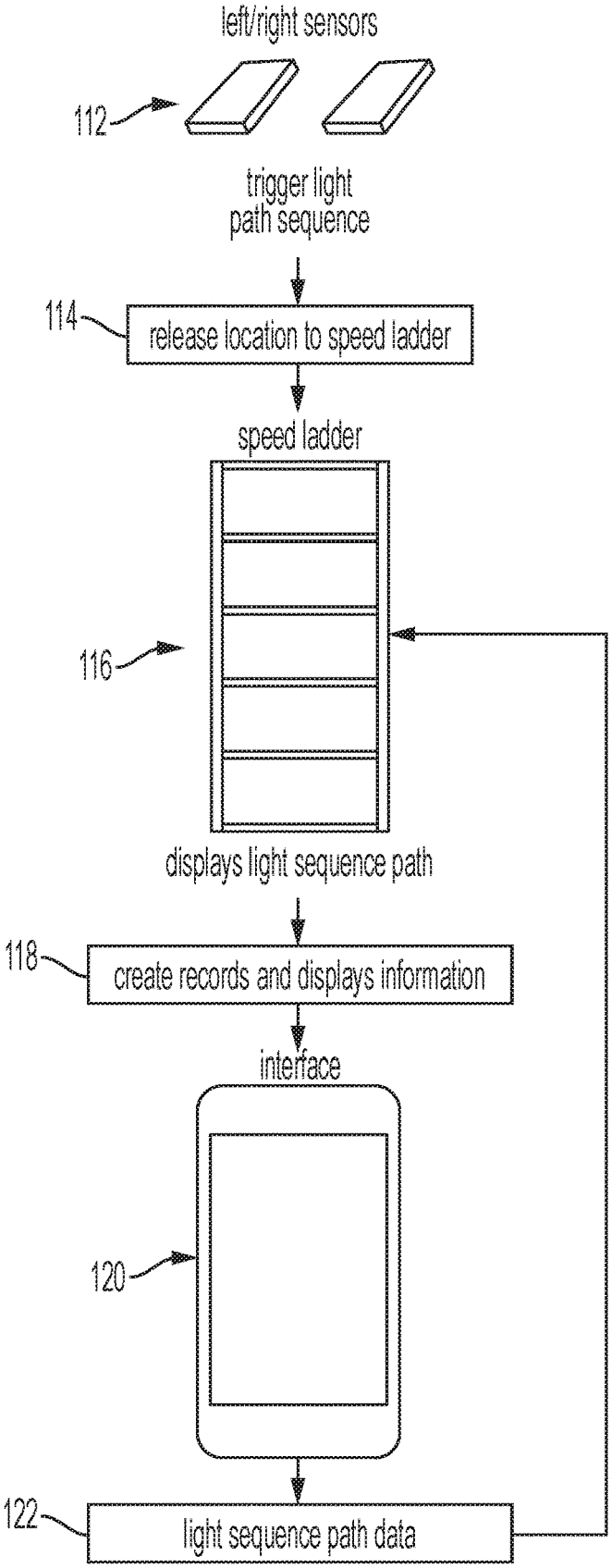
FIG. 1B is a flow diagram depicting exemplary interaction of sensors, a speed ladder, and a computing device, according to one or more embodiments shown and described herein.

Referring now to FIG. 1B, a flow diagram depicting exemplary interaction of sensors, a speed ladder, and a computing device is shown according to various embodiments. Sensors 112 are worn by a speed ladder user in this embodiment. For example, a user may wear a sensor 112 attached to the laces of each shoe to track their foot movement. Any suitable type of wireless activity tracking sensor (BLUETOOTH, Bluetooth Low Energy, NFC, Wi-Fi, radio wave, etc.) may be utilized to measure and track angle, path, height, and/or speed of each foot's movement. In some embodiments, more than one sensor on each foot (or anywhere else on the leg or other appendage) or no sensor on a foot may be utilized. In other embodiments, a sensor may store data and later be physically connected to another device to download the sensor's data. Two sensors 112 as a pair are tied or clipped into to the front of the user's left and right shoes, where each may be battery powered and/or rechargeable. An example of a sensor is METAMOTIONR (MMR) low energy Bluetooth motion tracker by MBIENTLAB, although any suitable sensor may be used. In this example, sensors 112 may include, for example, a gyroscope, an accelerometer, a magnetometer, a barometric pressure sensor, a temperature sensor, and an ambient light sensor. As explained in more detail below, a sensor (i.e., a z-locator) may be utilized to trigger a light path sequence in a speed ladder 100. Sensors 112 may utilize location tracking via any suitable protocol (such as BLUETOOTH), such that BLUETOOTH location data from sensors 112 may be provided to the communications module 110, which may track the location with respect to the speed ladder 100. In this way, the location data from the sensors 112 provides an indication of where the user steps with respect to the ladder 100.

At block 114, each sensor's location may be provided to the speed ladder's receiving module within the communication module 110. In this embodiment, this is done in real-time or near real-time. A communication module may be, for example, a microcontroller (IMU by X-IO Technologies) or programmable logic controller (JAZZ® & M91™ by UNITRONICS). The communication module 110 may feature a rechargeable battery to provide power to components such as the LED's 106. Other embodiments may provide for transmission for such information at specified intervals or upon certain events, such as completing certain steps in a speed ladder foot sequence or upon completion of the sequence. Block 116 features a depiction of a speed ladder, which receives the location data from the sensors in coordination with the lighting of its LEDs to measure user movement in regards to a light path sequence. At block 118, records containing data from the speed ladder 100 and the sensors may be transmitted to a device. In this embodiment, the transmission is wireless, but in other embodiments the speed ladder may utilize a wired connection to download this data to another device. Block 120 features a depiction of a device upon which an interface is run. Details of the interface are discussed in more detail below. At block 122 data is sent from the interface and its device to the speed ladder 100 in order to have the speed ladder generate a new light path sequence.

Figure 2A:
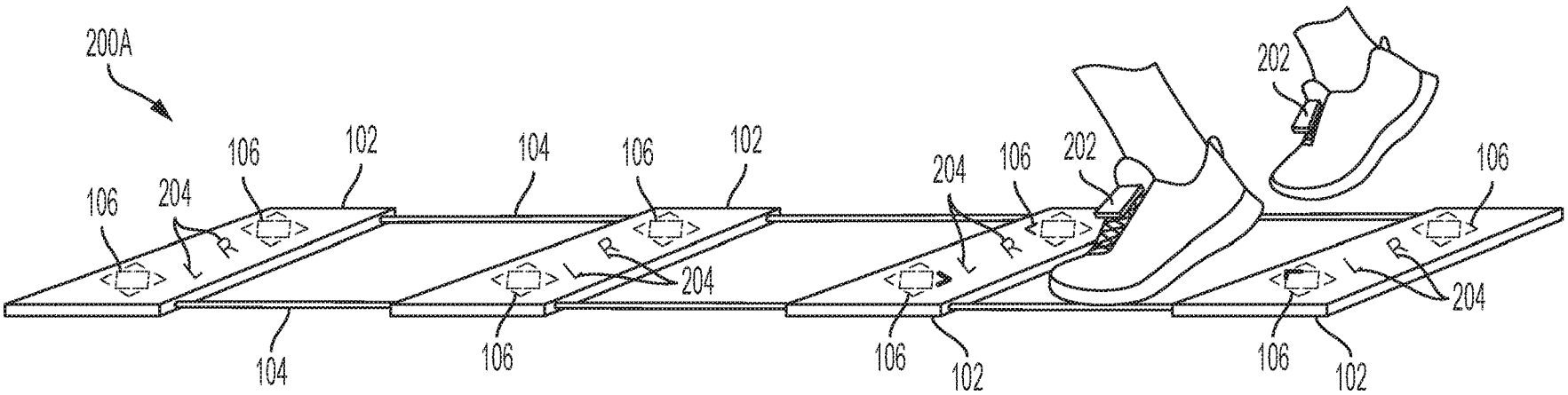
FIG. 2A schematically illustrates an exemplary operating environment featuring a user wearing sensors while utilizing a speed ladder having LEDs, according to one or more embodiments shown and described herein.

Turning now to FIG. 2A, an exemplary operating environment 200A featuring a user wearing sensors and utilizing a speed ladder having LEDs is shown according to various embodiments. In this embodiment, a user has a sensor 202 attached to each shoe, and is moving their feet in accordance with a light path sequence. Here, LEDs 106 light up to indicate where the user is to step. In this embodiment, each LED 106 location has arrow indicators, such that the LEDs 106 in front of and behind the indicated placement spot together point inward (i.e., the LED 106 up front points back towards the placement spot and the LED 106 behind the placement spot points forwards). This may help the user see LED indicators from a variety of vantage points, such as up front where the user cannot easily look backward while performing a foot movement sequence. Additionally, left and right indicators 204 may be printed onto the cross member 102 and/or light up to further indicate a foot placement location with respect to a user's left or right foot. If the next placement is for the right foot to be next to the left foot, then the LEDs 106 to the right may light up and the currently lit LEDs 106 may dim or go dark so as to avoid distracting the user. In some embodiments, this deactivation of LEDs may be based either upon the elapsed time periods or data from the sensors 202 indicating the user has moved on to the next foot placement.

Figure 2B:
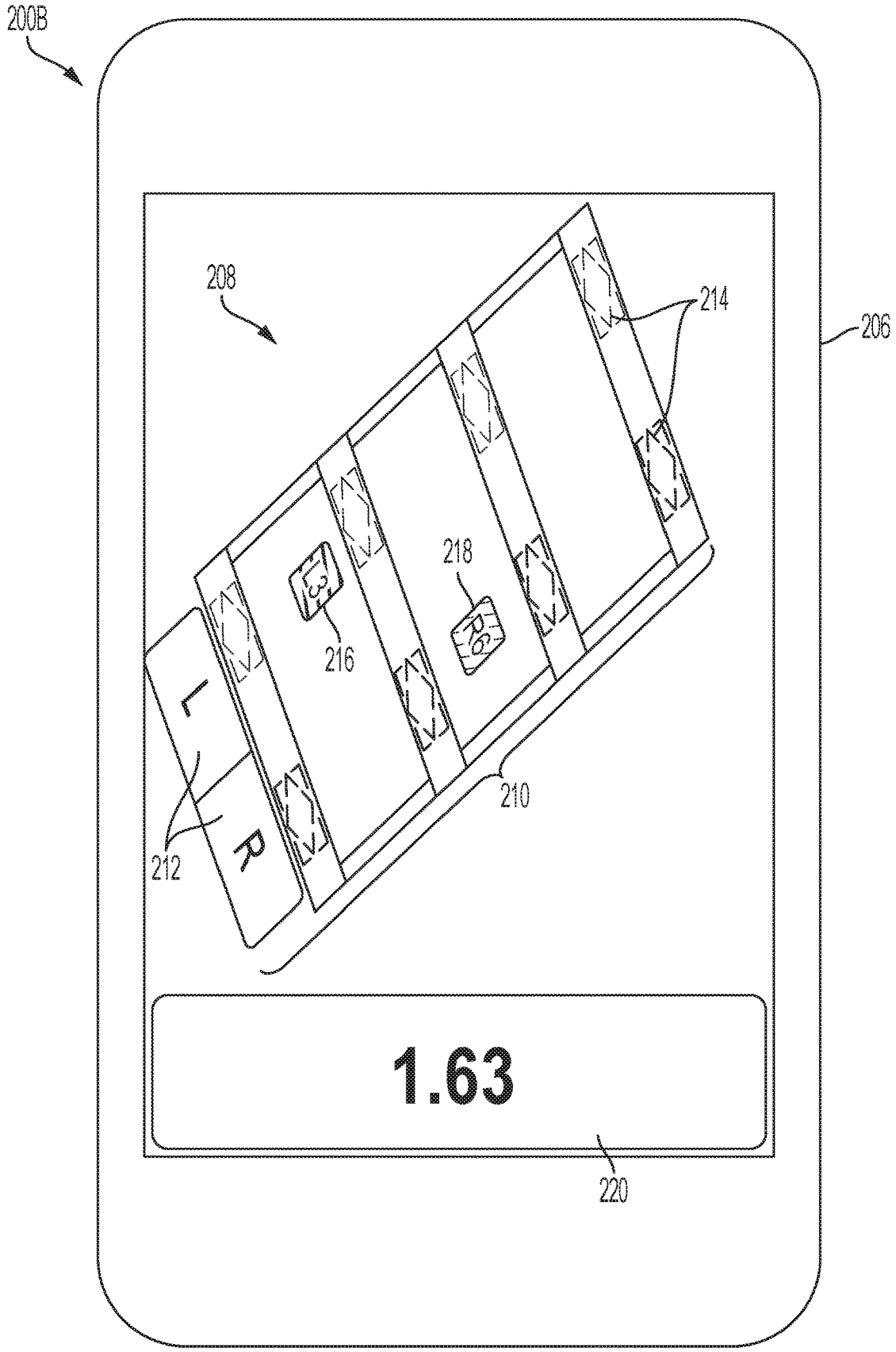
FIG. 2B schematically illustrates a graphical user interface with foot placement indicators with respect to a speed ladder, according to one or more embodiments shown and described herein.

Turning now to FIG. 2B, an exemplary operating environment 200B depicts a graphical user interface 208 with foot placement indicators in proximity to a speed ladder, through which embodiments of the disclosure can be implemented. In this embodiment, a device outputs the interface 208 on a display. The device 206 may be any device capable of outputting a graphical user interface 208, such as a smartphone, tablet, laptop, desktop, server, and the like. Within the interface 208, the user is presented with a representation of the speed ladder 210. In this embodiment, the speed ladder in the interface 208 also provides foot indicators 212 to indicate the orientation for left and right feet within the viewpoint of the interface 208. Lighting indicators 214 in this embodiment correspond to LEDs 106 on the speed ladder 100, where left lighting indicators 214 may be visually distinguished from right lighting indicators 214. In this embodiment, the user of the speed ladder and/or someone else may design a custom foot placement sequence and/or modify an existing one. For example, L3 in the left foot placement indicator 216 may indicate where the third foot placement in the light path sequence is located, which is for the left foot. Similarly, R6 in the right foot placement indicator 218 may indicate where the sixth placement (in the sequence) of the light path sequence is located, which is for the right foot. In this way, a user can create and/or modify a step-by-step sequence for each foot. In another embodiment, a step-by-step sequence may be created by the location data from the sensors 202. For example, the interface 208 may feature a recording mode that allows a user to record/capture a foot movement sequence (which may be from the interface user or another user), where the interface 208 may provide start/stop options for saving the recorded foot movement sequence as a step-by-step sequence in the interface 208.

In some embodiments, a displayed time value 220 may be adjustable, and may display an amount of time from the start of the foot placement sequence to a selected foot placement indicator (such as L3 or R6) or between any two foot placement locations. In other embodiments, the foot placement locations, rather than being based upon future foot placement, may reflect foot placement data based upon a user's past performance (where the past performance data may relate to the user of the interface 208 or a different user).

In another embodiment, a left foot placement indicator 216 may provide a live view of where the user's left foot is currently located, based upon sensor data, in relation to the speed ladder 210, along with a right foot placement indicator 218 that indicates where the user's right foot is currently located in relation to the speed ladder 210. Tracking the location and motion of the user's feet may be based upon data received from the sensors 202 worn by the user. A time value 220 may correspond to an amount of time at which a particular foot placement, or the entire speed ladder, should be completed or to show the current amount of elapsed time.

Figure 3A:
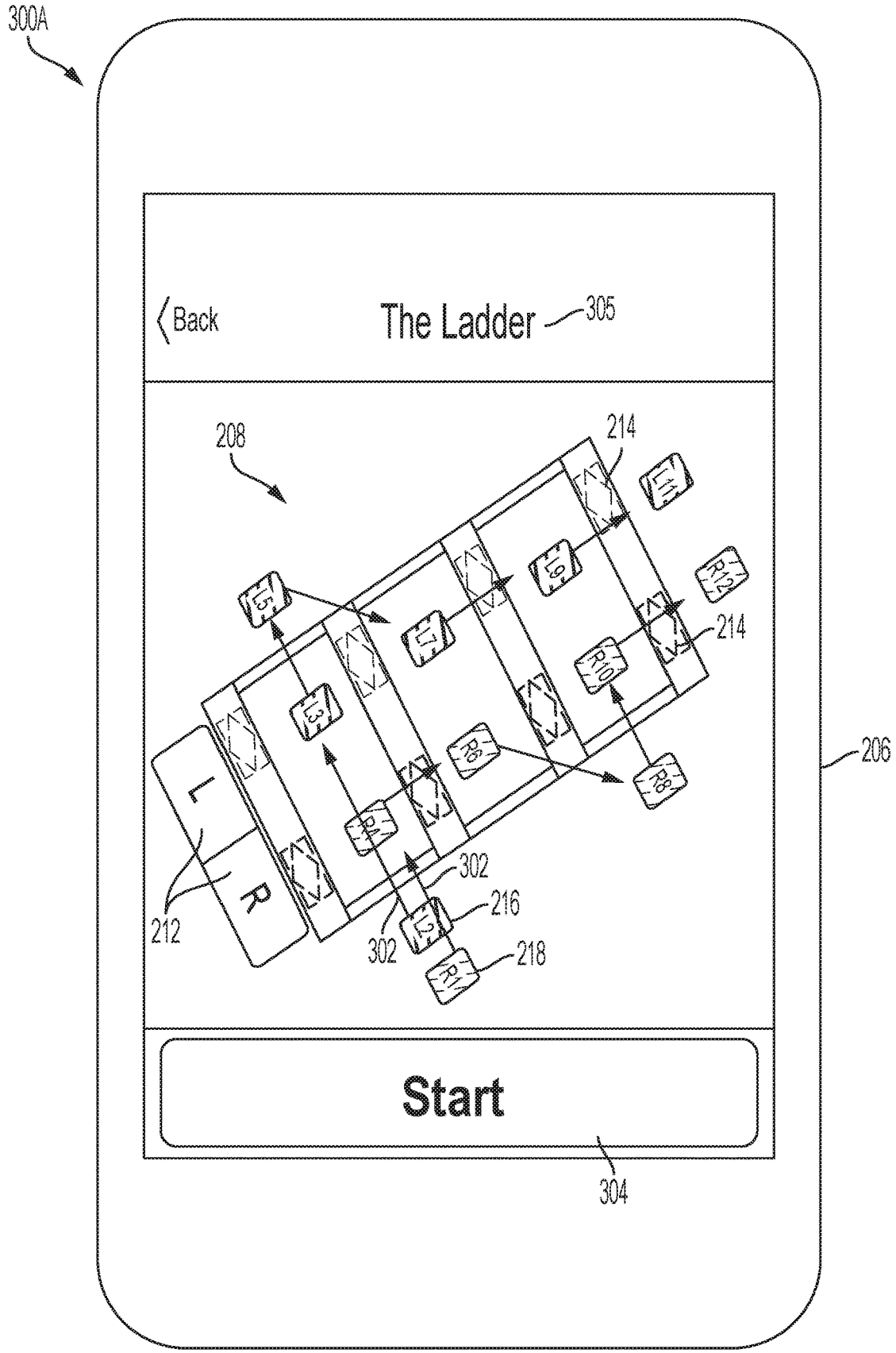
FIG. 3A schematically illustrates a graphical user interface with a foot placement sequence with respect to a speed ladder, according to one or more embodiments shown and described herein.

Turning now to FIG. 3A, an exemplary operating environment 300A depicts a graphical user interface 208 with foot placement indicators with respect to a speed ladder, through which embodiments of the disclosure can be implemented. In this example, the interface 208 displays a foot sequence for a user to complete. Starting with a right foot placement indicator 218 and a left foot placement indicator 216 outside the bottom-right of the speed ladder, the foot placement sequence then directs the user to proceed to L3, R4, and so until the user reaches L11 and R12 up in front of the speed ladder. Progression indicators 302 may be provided to show the user the relative movement of each foot with relation to the foot placement indicators (i.e., a progression indicator 302 shows how the first right foot placement proceeds to the next right foot placement at R4 and the first left foot placement proceeds to the next left foot placement at L3). Although progression indicators are shown as arrows, any suitable type of graphic may be utilized. A start button 304 may allow a user (which may be either the user of the speed ladder or another user) to initiate the foot placement sequence, which may correspond with the corresponding light path sequence. A customizable title 305 may also be displayed which may correspond to a file name. In some embodiments, data from the sensor 202 may be output directly to the operating environment 300A, such as being directly received by device 206 for use in the interface 208), and the communications module only utilizes data regarding LED light instructions.

Figure 3B:
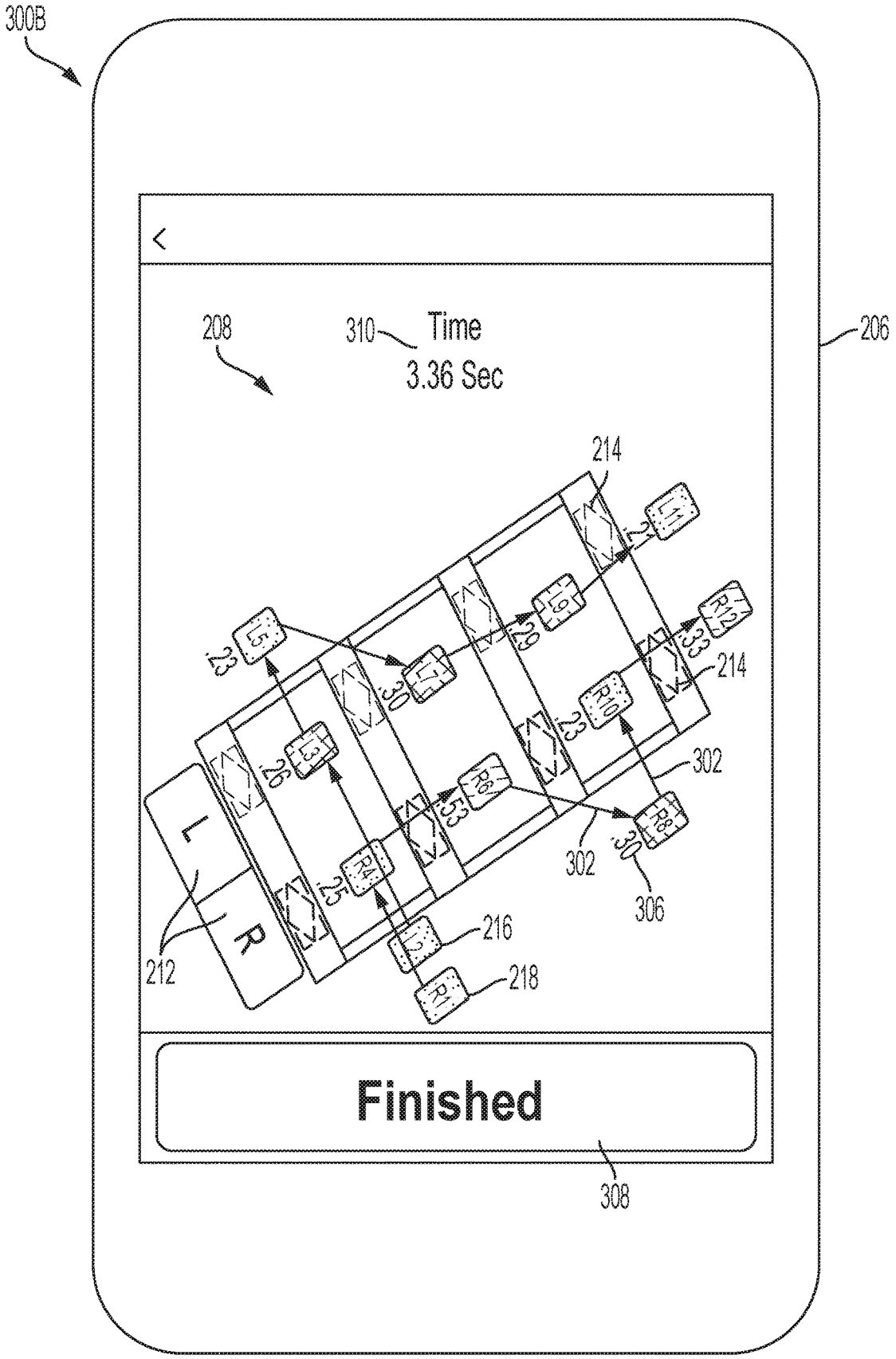
FIG. 3B schematically illustrates a graphical user interface with a foot placement sequence and timing indicators with respect to a speed ladder, according to one or more embodiments shown and described herein.

Turning now to FIG. 3B, an exemplary operating environment 300B depicts a graphical user interface 208 with foot placement indicators with respect to a speed ladder, through which embodiments of the disclosure can be implemented. In this embodiment, the interface 208 displays the foot placement sequence in FIG. 3A with target segment time 306. For example, a value of 0.30 at R8 means the user is expected to take the user 0.30 second to move their right foot from R6 to R8. Similarly, it would take 0.25 second to move their right foot from R1 to R4 and 0.26 second to move their left foot from L2 to L3. In another embodiment, the target segment time may reflect a cumulative amount of time (i.e., a time amount at R12 may aggregate all previous right foot movements, rather than just the time from R10 to R12). The user may be provided options as to what type of target segment time values to display. In a further embodiment, the time values may reflect previous segment completion times within a foot placement sequence.

In embodiments, a user can access through the interface a plurality of preset light path sequences, modify at least one of the plurality of preset light path sequences, and/or create a new light path sequence. In some embodiments, users can save and upload their performance data as well as load the performance data of other users. For example, a user may want to compare their abilities to a famous professional athlete. If foot placement sequence data is available for that athlete, it can be loaded through the interface 208 and provided to the speed ladder 100, which may then provide the loaded foot placement sequence as a light path sequence for the user to compete against. In some embodiments, target segment times 306 may be uniform. In various embodiments, target segment times 306 may be customizable though the interface, such that target segment time 306 may be modified without affecting other target segment times 306 in the foot placement sequence. In some embodiments, a foot placement sequence may be adaptable, such that target segment times 306 may be automatically increased if a user on the speed ladder is having trouble keeping up or the target segment times 306 may be automatically decreased if a user is moving quicker than the foot placement sequence. In some embodiments, minimum and/or maximum threshold values may be used to terminate the foot placement sequence if the user moves slower than a minimum threshold speed value or faster than a maximum threshold speed value. In some embodiments, the aggregate foot movement sequence, along with each foot movement in the sequence, may have modifiable maximum and/or minimum time thresholds. In various embodiments, one or more customizable delay values may be provided to add a time buffer to one or more segments and/or lights in the light path sequence data. A delay value may be uniform with respect to each light in the light path sequence data or each light and/or each segment may have its own delay value. A finish option 308 may allow a user to terminate the foot placement sequence.

A time indicator 310 may be displayed to represent a current elapsed time. In other embodiments, this may be provided as a playback timer where the foot placement indicators show where a past user was located at a particular time. For example, the foot placement indicators may light up with respect to the passage of time in the indicator (e.g., rewinding a previous foot placement sequence would result in the foot placement indicators lighting up in reverse order in the interface 208). In other embodiments, the time indicator 310 may provide a total amount of time that completing the stored foot placement sequence took. In some embodiments, a ranking of top times for a given foot placement sequence may be utilized. For example, if a user uploads their performance data for a given foot placement sequence, their performance can be compared against how other users did for the same foot placement sequence. A social media website may post the times of various users for a given foot placement sequence, such as in a continuously updated top 10, and may make the foot placement sequence of other users available for download.

Figure 4A:
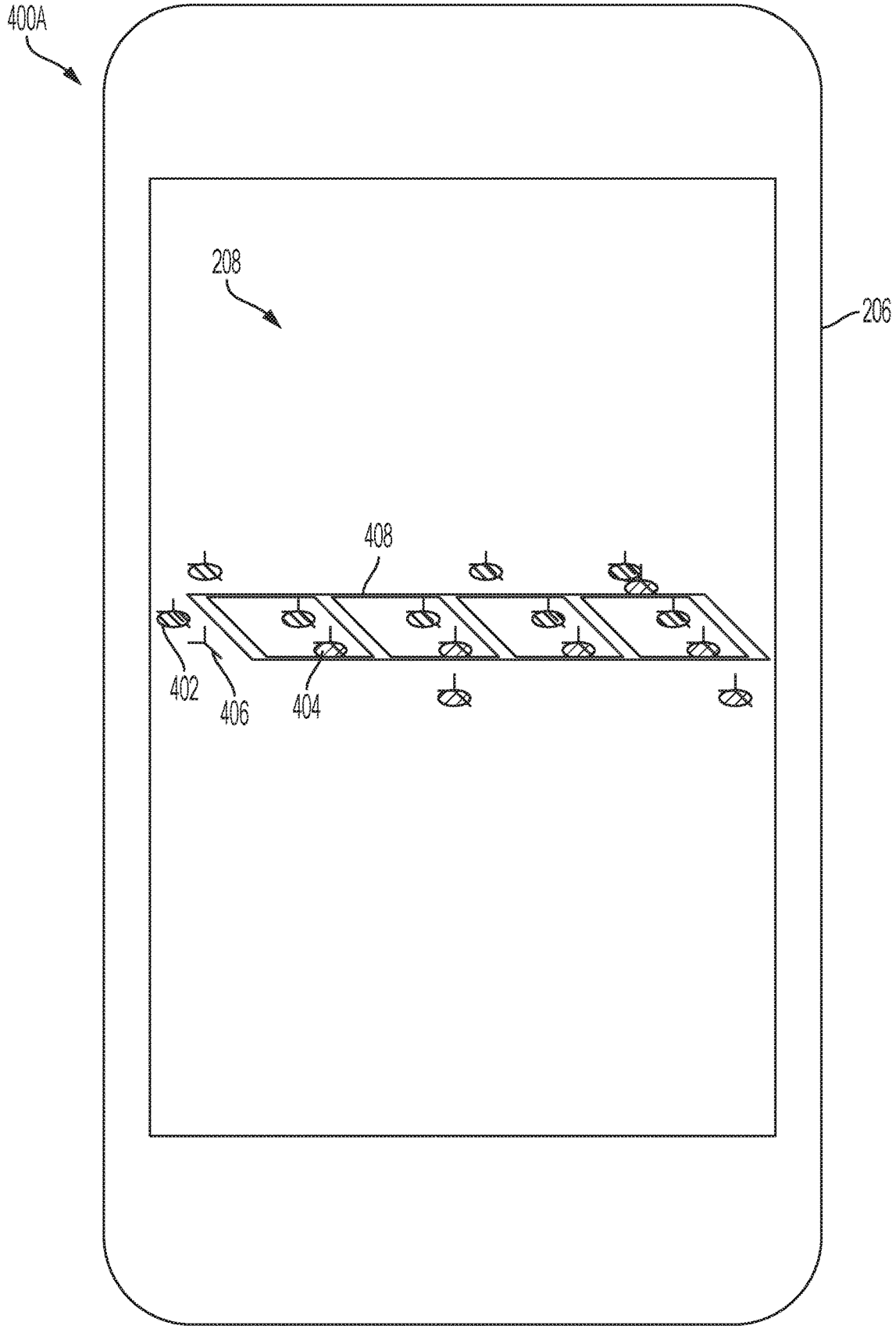
FIG. 4A schematically illustrates a graphical user interface with axial foot placement data with respect to a speed ladder, according to one or more embodiments shown and described herein.

Turning now to FIG. 4A, an exemplary operating environment 400A depicts a graphical user interface 208 with foot placement indicators with respect to a speed ladder, through which embodiments of the disclosure can be implemented. In this example, the interface 208 displays left foot placement indicators 402 and right foot placement indicators 404 in and around a representation of the speed ladder 408. Each indicator is also provided with an x-y-z three-dimensional axial representation 406.

Figure 4B:
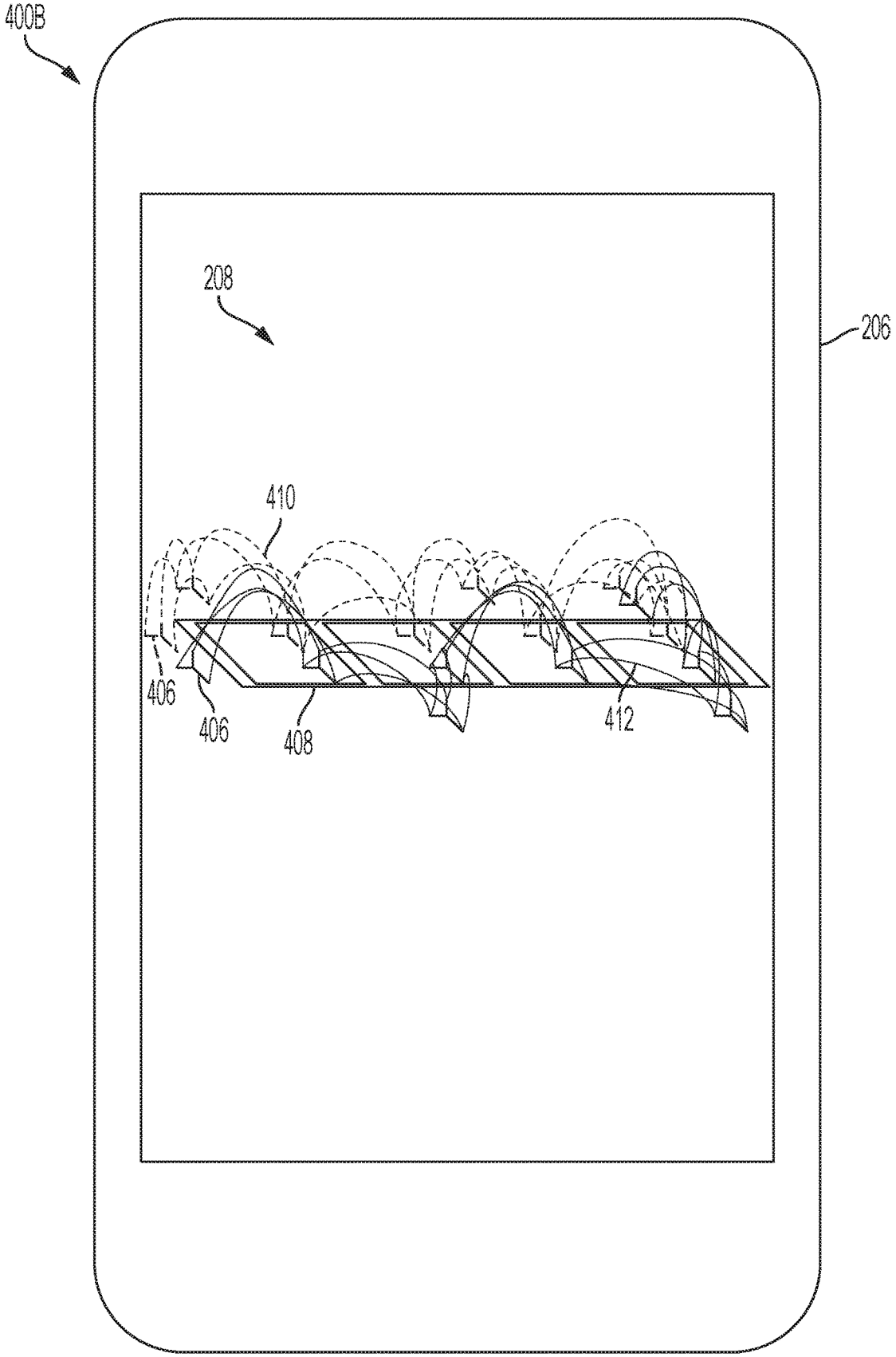
FIG. 4B schematically illustrates a graphical user interface with axial foot placement and foot movement data with respect to a speed ladder, according to one or more embodiments shown and described herein.

Turning now to FIG. 4B, an exemplary operating environment 400B depicts a graphical user interface 208 with foot placement indicators with respect to a speed ladder, through which embodiments of the disclosure can be implemented. In some embodiments, the interface is configured to receive from user sensors 202 data from the left foot movement 410 and right foot movement 412 for determining Quaternion (i.e., representing three dimensional orientations and rotations), rotation matrices, Euler Angles (robust heading estimation and yaw, pitch, roll), linear acceleration, Earth acceleration (gravity), and the like, which may be utilized to determine a foot movement direction, length of a foot placement, a height pertaining to how high a foot moves off of a ground surface during the foot placement, and location of motion of the foot placement. Continuing with the embodiment of the interface 208 in FIG. 4A, left foot movement data 410 and right foot movement data 412 are displayed with respect to the axial representations 406 for each left foot placement indicator 402 and right foot placement indicator 404. By analyzing sensor data of a user's foot between placement indicators, movement in each dimension (x, y, z) may be analyzed. In addition to timing data, this analysis can be provided to the user to help them analyze and thereby improve their form from the left foot movement data 410 and right foot movement data 412. For example, while a user's foot may have a good height arc in the z direction, the user may be sticking their foot out too far in the y direction.

Figure 5:
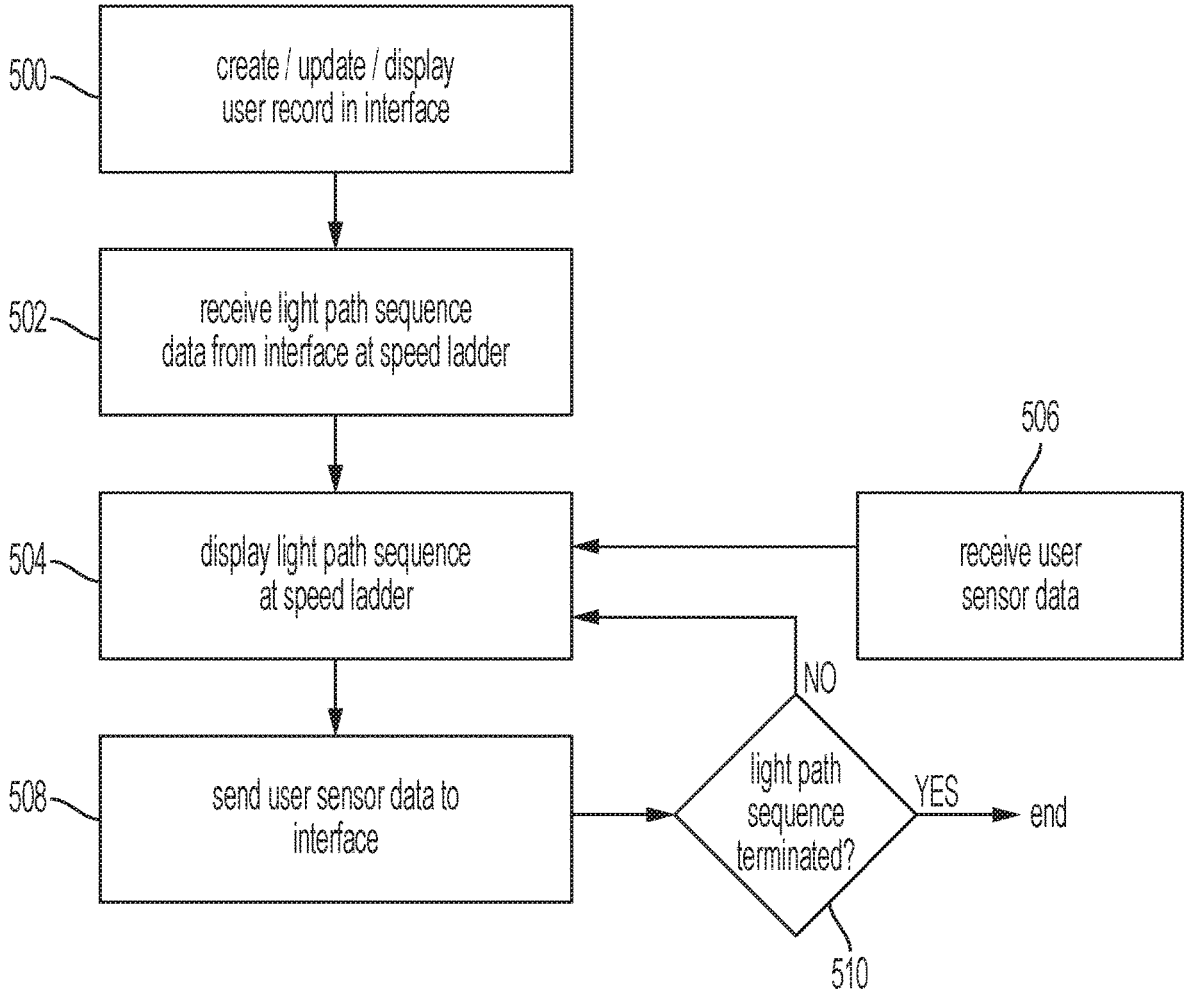
FIG. 5 is a flow chart depicting the interaction of sensors, speed ladder, and interface, according to one or more embodiments shown and described herein.

Turning now to FIG. 5, a flowchart of the exemplary interaction of sensors, speed ladder, and interface is shown according to various embodiments. At block 500, one or more user records are created, updated, and/or displayed at the graphical user interface 208. User records may be stored and/or accessed locally on the device running the interface or remotely (such as in a database, which may be remote, as discussed herein). At block 502, the interface transmits light path sequence data to the speed ladder. At block 504, the speed ladder displays the light path sequence according to the light path sequence data received from the interface and also from user sensor data received by sensors worn by the user of the speed ladder. In this embodiment, the light path sequence may also be based upon the light path sequence data received by the interface at block 506, and may be modified as sensor data is received corresponding to foot placements of the user. For example, an adaptive light path sequence may speed up or slow down subsequent lights in the sequence based upon the user exceeding or failing to meet expected times in earlier foot placement segments. In some embodiments, a delay value to increase the time between placement indicators may be modified based upon a change in user performance. At block 508, user sensor data may be sent to the interface. A determination may then be made at block 510 as to whether a light path sequence has terminated. In some embodiments the determination may be made based upon the location of the sensors relative to the speed ladder. For example, once both sensors report that the user's feet have reached the last two locations in the foot movement sequence, then the sequence may be deemed to have terminated. In another example, if a user steps outside of the speed ladder to a location where there are no left or right foot placement indicators to the corresponding location in the interface, then the interface may determine that the user has been disqualified for not following the foot movement sequence. If the light path sequence has not terminated, then the flowchart returns to block 504 to continue displaying the light path sequence. Otherwise, if the light path sequence has terminated, then in this embodiment the flowchart ends. In other embodiments the flowchart may return to other parts of the flowchart.

Figure 6:
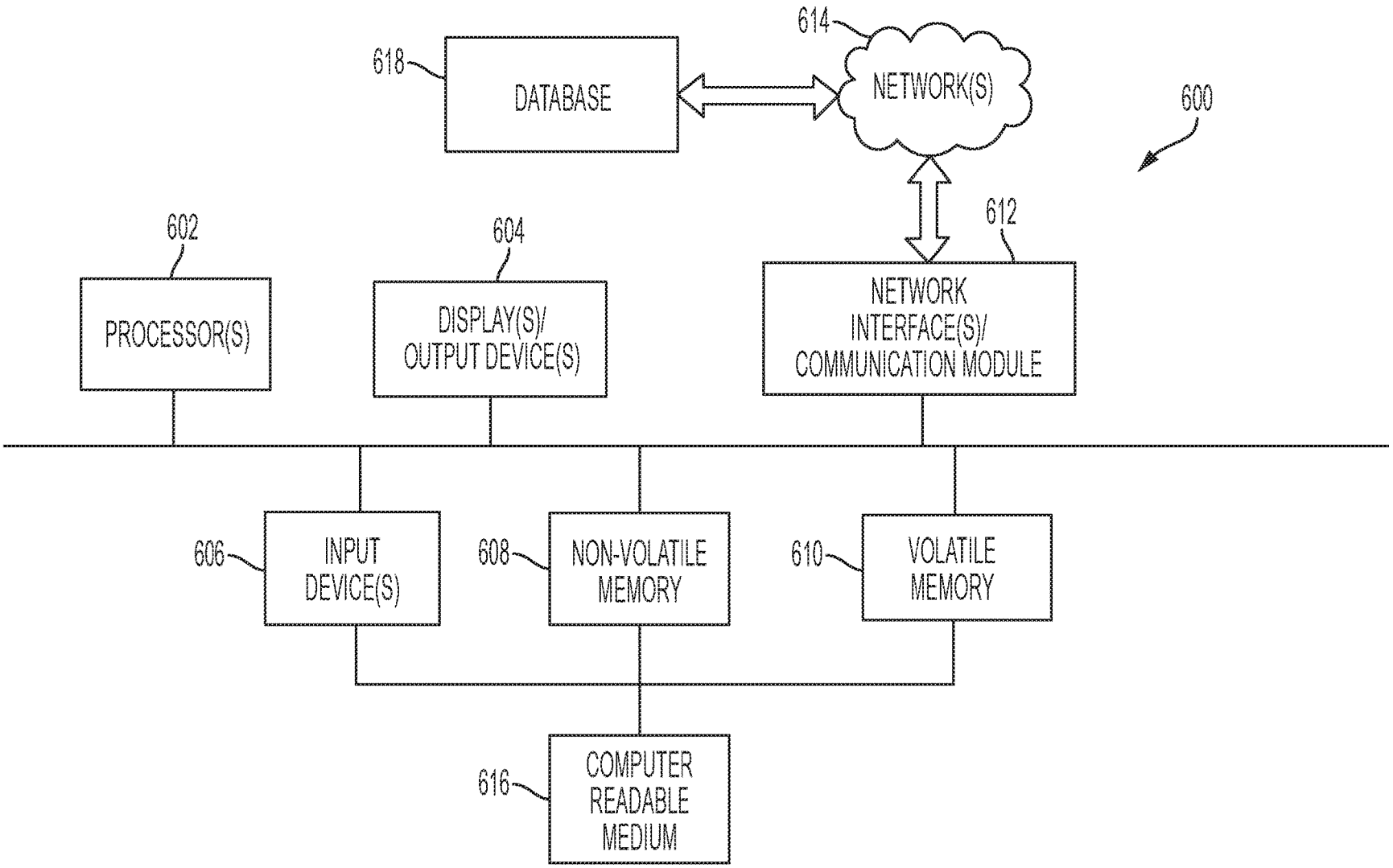
FIG. 6 is a block diagram illustrating computing hardware utilized in one or more speed ladders, devices which host the app, and sensors, according one or more embodiments shown and described herein.

Turning now to FIG. 6, a block diagram illustrates an exemplary computing device 600, through which embodiments of the disclosure can be implemented. The computing device 600 described herein is but one example of a suitable computing device and does not suggest any limitation on the scope of any embodiments presented. The computing device 600 in some embodiments may also be utilized to implement a speed ladder 100, a sensor 202, a device 206 and/or any combination thereof. Nothing illustrated or described with respect to the computing device 600 should be interpreted as being required or as creating any type of dependency with respect to any element or plurality of elements. In various embodiments, a computing device 600 may include, but need not be limited to, a desktop, laptop, server, client, tablet, smartphone, or any other type of device that can compress data. In an embodiment, the computing device 600 includes at least one processor 602 and memory (non-volatile memory 608 and/or volatile memory 610). The computing device 600 can include one or more displays and/or output devices 604 such as monitors, speakers, headphones, projectors, wearable-displays, holographic displays, and/or printers, for example. Output devices 604 may further include, for example, LED's 106 and/or audio speakers in a speed ladder 100, a screen and/or audio speakers in a device 206, devices that emit energy (radio, microwave, infrared, visible light, ultraviolet, x-ray and gamma ray), electronic output devices (Wi-Fi, radar, laser, etc.), audio (of any frequency), etc.

The computing device 600 may further include one or more input devices 606 which can include, by way of example, any type of mouse, keyboard, disk/media drive, memory stick/thumb-drive, memory card, pen, touch-input device, biometric scanner, voice/auditory input device, motion-detector, camera, scale, and the like. Input devices 606 may further include sensors 202, sensing components of a device 206 (touch screen, buttons, accelerometer, light sensor, etc.), and any device capable of measuring data such as motion data (accelerometer, GPS, magnetometer, gyroscope, etc.), biometric (blood pressure, pulse, heart rate, perspiration, temperature, voice, facial-recognition, iris or other types of eye recognition, hand geometry, fingerprint, DNA, dental records, weight, or any other suitable type of biometric data, etc.), video/still images, and audio (including human-audible and human-inaudible ultrasonic sound waves). Input devices 606 may further include cameras (with or without audio recording), such as digital and/or analog cameras, still cameras, video cameras, thermal imaging cameras, infrared cameras, cameras with a charge-couple display, night-vision cameras, three-dimensional cameras, webcams, audio recorders, and the like.

The computing device 600 typically includes non-volatile memory 608 (ROM, flash memory, etc.), volatile memory 610 (RAM, etc.), or a combination thereof. A network interface 612 can facilitate communications over a network 614 via wires, via a wide area network, via a local area network, via a personal area network, via a cellular network, via a satellite network, etc. Suitable local area networks may include wired Ethernet and/or wireless technologies such as, for example, wireless fidelity (Wi-Fi). Suitable personal area networks may include wireless technologies such as, for example, IrDA, Bluetooth, Wireless USB, Z-Wave, ZigBee, and/or other near field communication protocols. Suitable personal area networks may similarly include wired computer buses such as, for example, USB and FireWire. Suitable cellular networks include, but are not limited to, technologies such as LTE, WiMAX, UMTS, CDMA, and GSM. Network interface 612 can be communicatively coupled to any device capable of transmitting and/or receiving data via one or more network(s) 614. Accordingly, the network interface hardware 612 can include a communication transceiver for sending and/or receiving any wired or wireless communication. For example, the network interface hardware 612 may include an antenna, a modem, LAN port, Wi-Fi card, WiMax card, mobile communications hardware, near-field communication hardware, satellite communication hardware and/or any wired or wireless hardware for communicating with other networks and/or devices. One or more databases 618 may be accessed via the network(s) to remotely access data and store data, such as performance data relating to the user's performance on the speed ladder 100 via the interface 208 and data obtained from the sensors 112.

A computer-readable medium 616 may comprise a plurality of computer readable mediums, each of which may be either a computer readable storage medium or a computer readable signal medium. A computer readable storage medium may reside, for example, within an input device 606, non-volatile memory 608, volatile memory 610, or any combination thereof. A computer readable storage medium can include tangible media that is able to store instructions associated with, or used by, a device or system. A computer readable storage medium includes, by way of example: RAM, ROM, cache, fiber optics, EPROM/Flash memory, CD/DVD/BD-ROM, hard disk drives, solid-state storage, optical or magnetic storage devices, diskettes, electrical connections having a wire, or any combination thereof. A computer readable storage medium may also include, for example, a system or device that is of a magnetic, optical, semiconductor, or electronic type. Computer readable storage media and computer readable signal media are mutually exclusive.

A computer readable signal medium can include any type of computer readable medium that is not a computer readable storage medium and may include, for example, propagated signals taking any number of forms such as optical, electromagnetic, or a combination thereof. A computer readable signal medium may include propagated data signals containing computer readable code, for example, within a carrier wave. Computer readable storage media and computer readable signal media are mutually exclusive.

The computing device 600 may include one or more network interfaces 612 to facilitate communication with one or more remote devices, which may include, for example, client and/or server devices. A network interface 612 may also be described as a communications module, as these terms may be used interchangeably.

It is noted that recitations herein of a component of the present disclosure being "configured" or "programmed" in a particular way, to embody a particular property, or to function in a particular manner, are structural recitations, as opposed to recitations of intended use. More specifically, the references herein to the manner in which a component is "configured" or "programmed" denotes an existing physical condition of the component and, as such, is to be taken as a definite recitation of the structural characteristics of the component.

The order of execution or performance of the operations in examples of the disclosure illustrated and described herein is not essential, unless otherwise specified. That is, the operations may be performed in any order, unless otherwise specified, and examples of the disclosure may include additional or fewer operations than those disclosed herein. For example, it is contemplated that executing or performing a particular operation before, contemporaneously with, or after another operation is within the scope of aspects of the disclosure.

It is noted that the terms "substantially" and "about" and "approximately" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A non-transitory computer readable medium comprising instructions that, when executed by a processor, cause a software application to:

receive, from a plurality of user sensors attached to a user, user foot movement data relative to a speed ladder;

create and display a record associated with the user based upon the foot movement data;

output, to a plurality of lights within the speed ladder, light path sequence data configured to activate a light path sequence in the plurality of lights; and modify a separate delay value associated with each of the plurality of lights in the light path sequence data wherein each said separate delay value for each of the plurality of lights is individually modified based upon a change in performance of the user.

2. The non-transitory computer readable medium of claim 1 further comprising instructions to access a plurality of preset light path sequences.

3. The non-transitory computer readable medium of claim 2 further comprising instructions received to modify at least one of the plurality of preset light path sequences or to create a new light path sequence.

4. The non-transitory computer readable medium of claim 1 further comprising instructions to activate the light path sequence based upon the record associated with the user.

5. The non-transitory computer readable medium of claim 1 further comprising instructions to activate the light path sequence based upon the record associated with another user.

6. The non-transitory computer readable medium of claim 1 further comprising instructions to receive input through the software application to modify the light path sequence data.

7. The non-transitory computer readable medium of claim 6 wherein the delay value is uniform with respect to each of the plurality of lights in the light path sequence data.

8. The non-transitory computer readable medium of claim 6 wherein each of the plurality of lights in the light path sequence data has a separate delay value.

9. The non-transitory computer readable medium of claim 1 further comprising instructions to measure an amount of pressure generated by each foot placement, provide angle correction feedback where a user angle exceeds a threshold angle amount, and wherein a first foot placement of the user commences a start time of the light path sequence associated with the user.

10. The non-transitory computer readable medium of claim 1 further comprising instructions to compare with other records one or more timing values stored in the record associated with the user.

11. The non-transitory computer readable medium of claim 1 further comprising instructions to comparatively and simultaneously display within a single interface angles, paths, heights, and speeds of a plurality of users for each foot placement in a foot placement sequence.

12. The non-transitory computer readable medium of claim 1 further comprising instructions to display an angle, path, height, and speed for each foot placement in a foot placement sequence.

13. The non-transitory computer readable medium of claim 1 further comprising target segment times that are individually automatically increased based upon the user exceeding the target segment times in a foot placement sequence and individually automatically decreased based upon the user beating the target segment times in the foot placement sequence.

14. A method comprising:

receiving, from a plurality of user sensors attached to a user, foot movement data of the user relative to a speed ladder;

creating and displaying a record associated with the user based upon the foot movement data;

outputting, to a plurality of lights within the speed ladder, light path sequence data configured to activate a light path sequence in the plurality of lights; and modifying a separate delay value associated with each of the plurality of lights in the light path sequence data wherein each said separate delay value for each of the plurality of lights is individually modified based upon a change in performance of the user.

15. The method of claim 14 further comprising target segment times that are individually automatically increased based upon the user exceeding the target segment times in a foot placement sequence and individually automatically decreased based upon the user beating the target segment times in the foot placement sequence.

* * * * *